US005657925A

United States Patent [19]

Norris

[11] Patent Number: 5,657,925

[45] Date of Patent: Aug. 19, 1997

[54] CONTAINER HAVING INTEGRALLY FORMED DIVIDERS

[75] Inventor: Walter D. Norris, Cedar Hill, Tex.

[73] Assignee: ACCO USA, Wheeling, Ill.

[21] Appl. No.: 564,671

[22] Filed: Nov. 29, 1995

[51] Int. Cl.[6] ..... B65D 5/4805

[52] U.S. Cl. ..... 229/120.13; 229/120.18; 229/120.34

[58] Field of Search ..... 229/120.13, 120.18, 229/120.33, 120.34; 206/425; 220/529, 531

[56] References Cited

U.S. PATENT DOCUMENTS

| | | | |
|---|---|---|---|
| 1,770,681 | 7/1930 | Walter | 229/120.34 |
| 2,233,221 | 2/1941 | Olivier | 229/120.18 |
| 2,910,220 | 10/1959 | Hamilton | 229/120.34 |
| 2,914,235 | 11/1959 | Jones | 229/120.34 |
| 3,297,228 | 1/1967 | Contratto | 229/120.13 |
| 3,724,920 | 4/1973 | Beck | 206/425 |
| 4,250,992 | 2/1981 | Gilbert | 229/120.18 |

*Primary Examiner*—Gary E. Elkins
*Attorney, Agent, or Firm*—Pennie & Edmonds

[57] ABSTRACT

A container having dividers integrally formed onto an upper edge of its side walls is described. The dividers comprise an attachment portion that is attached to the side walls and a divider portion attached to the attachment portion. The divider portion comprises three sections adapted to occupy one of two positions. The combined lengths of the first and second sections is substantially equal to the width of the container. The third section comprises a flap adapted to tucked into a space formed between an opposing side wall and the downwardly folded attachment portion. Cutouts formed in an inside bottom of the container accommodate tabs formed on the first and third sections of the divider portion to maintain the divider in place.

14 Claims, 3 Drawing Sheets

CONTAINER HAVING INTEGRALLY FORMED DIVIDERS

BACKGROUND

The present invention relates to containers having multiple compartments. More particularly, it is directed to boxes having integrally formed dividers for creating these compartments. Boxes contemplated by the present invention are preferably used for storing documents or file folders, or the like, be they letter size, or legal size, or both.

File folders typically come in two lengths, either letter size (11¾") or legal size (14¾"). Such file folders are designed to contain letter size (11") or legal size (14") documents. Some paperboard containers are designed to efficiently store folders of either size by simply orienting the container in the proper direction. This allows a user to purchase a single container regardless of which size folder is to be stored.

There are, however, instances where folders of more than one size should be stored together. In such cases, storing shorter length folders in the same container with longer length folders will waste space. What is needed is a container which can accommodate folders of both sizes simultaneously without wasting unused space.

SUMMARY OF THE INVENTION

One object of the present invention is to provide a foldable container which can accommodate items, such as documents and file folders, of two different sizes without wasting space when both sizes of items are placed therein.

A second object of the invention is to provide a foldable container having multiple compartments created by integrally formed dividers which may optionally be deployed.

Generally, the container is constructed to provide either a single compartment or multiple compartments by the use of at least one foldable member. The foldable member is attached to an upper edge of a side wall of the container. The member includes a divider portion which is movable to either of two positions. In the first position, the divider portion extends parallel to the side wall of the container so that a single compartment is provided. This single compartment is sized to accommodate a first configuration of items. In the second position, the divider portion extends across the container to form a partition and divide the container into two compartments. These two compartments are sized to accommodate a second configuration of items different from the first configuration.

In the preferred embodiment of the invention, the container is substantially rectangular and has a width sized to match the width of either legal size items or letter size items. When the divider portion is in the first position along the side wall of the container, the entire single compartment of the container is used to accommodate either letter size or legal size items extending across the container, as dictated by the width of the container. When the divider portion is in the second position, it extends across the width of the container to form a partition and divide the container into two compartments. At least one of these compartments is sized to accommodate items of a size which is different from the items accommodated when the divider is in its first position.

BRIEF DESCRIPTION OF THE DRAWINGS

The present invention may be understood with reference to the attached figures wherein.

DETAILED DESCRIPTION OF THE PREFERRED EMBODIMENT

Figure 1:
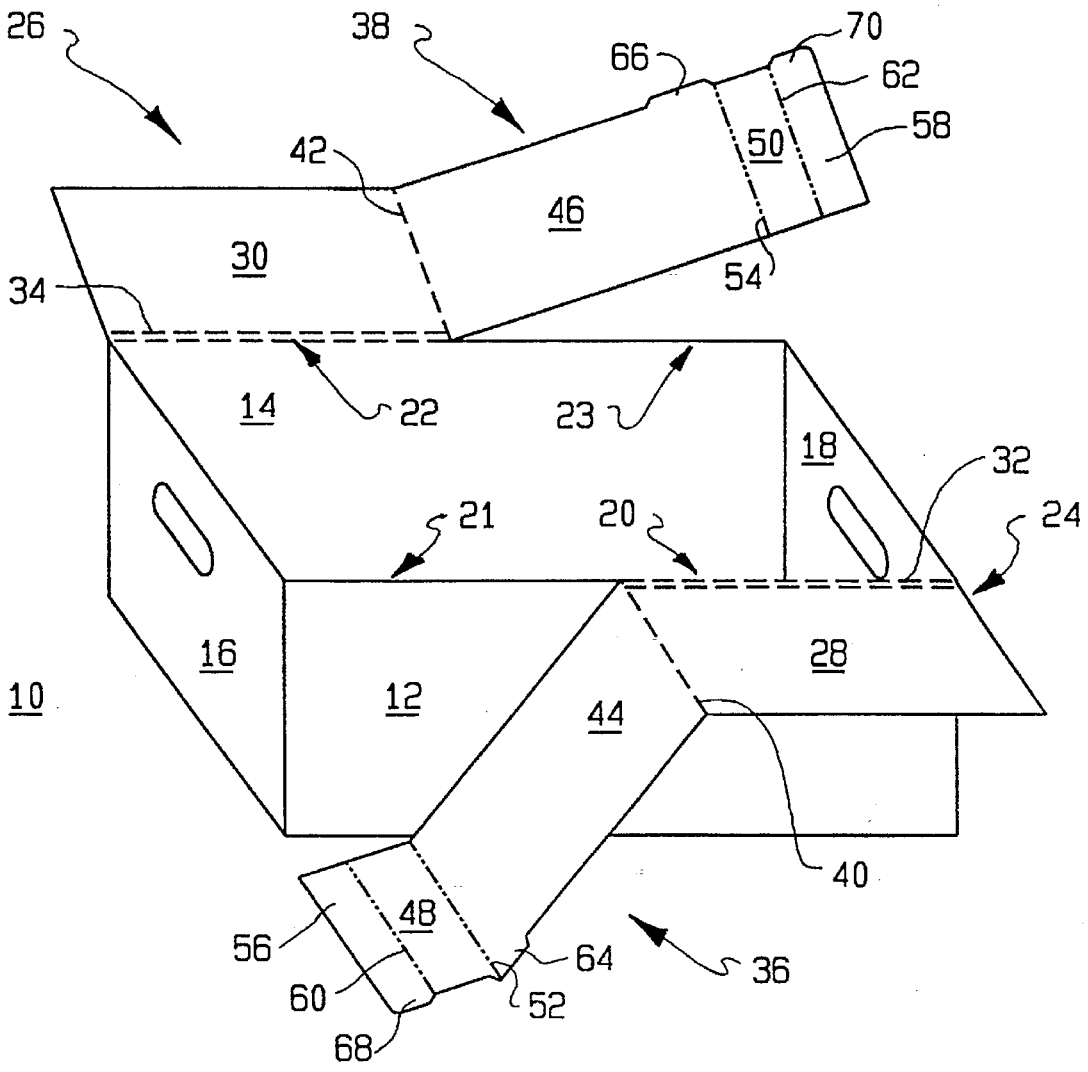
FIG. 1 is a perspective view of a container made in accordance with the present invention and having two members.

FIG. 1 shows a container 10 in accordance with the present invention. Preferably, the container is formed from paperboard, cardboard, pasteboard or the like. Container 10 comprises a pair of side walls 12, 14 and a pair of end walls 16, 18. The width of the container 10, taken along the end walls 16, 18, is sufficient to accommodate legal size file folders. Its length taken along the side walls 12, 14, is sufficient to accommodate two letter size file folders side by side.

The side walls have a first part 20, 22 and a second part 21, 23. Attached to an upper edge of the first part 20, 22 of the side walls is a first downwardly foldable member 24, and a second downwardly foldable member 26, respectively.

The downwardly folding members 24, 26 are attached to the side walls 12, 14 at attachment portions 28, 30, respectively. Each attachment portion has a length corresponding to the first part of the side wall. Preferably, In the preferred embodiment, a double row of perforations 32, 34 forms a double hinge along each attachment region. The double hinge facilitates folding the members downward into the container.

Attached to the attachment portion 28, 30 of each member are respective divider portions, shown generally as 36, 38. A single row of perforations 40, 42 forms a hinge between the attachment and divider portions. The divider portions 36, 38 each comprise three sections separated from one another by fold lines. First sections, designated 44 and 46, respectively, are attached to respective attachment portions 28, 30. First sections 44, 46 extend along second parts 21, 23 of the respective side walls 12, 14. The first sections 44, 46 are separated from the respective second sections 48, 50 by a first pair of fold lines 52, 54 indicated in FIG. 1 as dotted lines. The second sections, in turn, are separated from the respective third sections 56, 58 by a second pair of fold lines 60, 62, also indicated by dotted lines.

The first sections 44, 46 are provided on an outer edge thereof with anchor tabs 64, 66, respectively. The third sections 56, 58 are provided on an outer edge thereof with slightly smaller end tabs 68, 70. All four tabs interact with corresponding cutouts in an inner bottom 72, as described further below.

Figure 2:
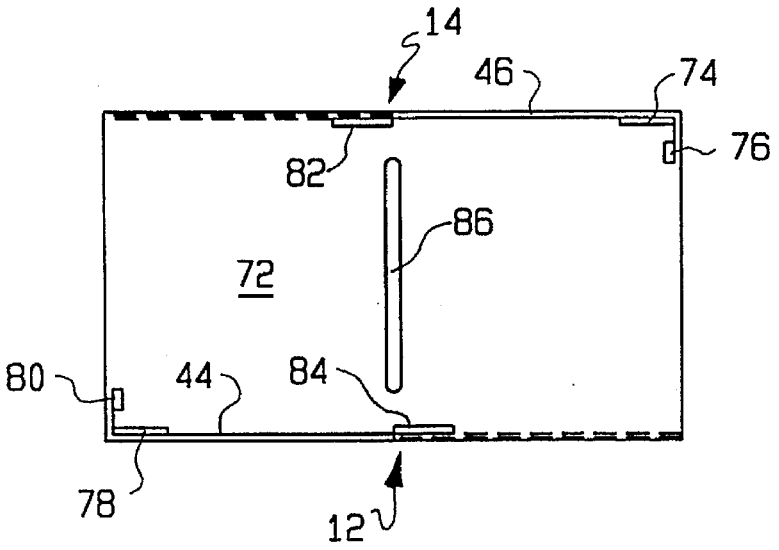
FIG. 2 is a top view of a container showing the divider portions in the first position.

FIG. 2 shows the container with its divider portions arranged in a first position. In the first position, the first sections 44, 46 parallel the second parts 21, 23 of side walls 12, 14, respectively. In this position, the container is not partitioned into compartments. The first sections 44, 46 extend to the end walls 16, 18, respectively. There, the divider portions undergo a right-angled bend causing the second and third sections to parallel the end walls. These bend areas between the first and second sections coincide with the fold lines 52, 54 shown in FIG. 1.

Figure 3:
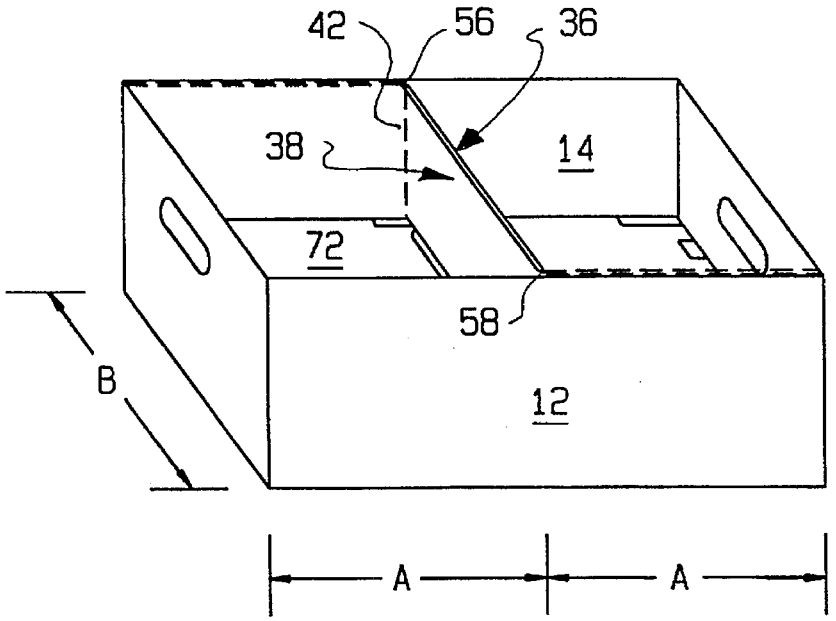
FIG. 3 is a perspective view of the container of FIG. 1 showing the divider portions in the second position to create two compartments.

FIG. 3 shows the container with its divider portions arranged in a second position. The foldable members are folded downward and the divider portions 36, 38 are positioned perpendicularly to the side walls 12, 14. Preferably, the compartments formed by the divider portions are of equal size with width A and depth B, as best shown in FIG. 3. The depth of the container, B, does not change appreciably upon formation of the partitions. Preferably, the third sections 56, 58 are shaped so as to serve as flaps suitable for tucking into spaces formed between the attachment portions 30, 28 and the side walls 14, 12 when the opposite members 26, 24 are folded down. This creates two compartments separated by a double wall formed by the divided portions 36 and 38.

The row of perforations 40, 42 between the attachment and divider portions of each member facilitates the manipulation of the first sections 44, 46 to form the double wall. As shown in FIG. 3, the partition walls preferably extend downward to the inner bottom 72 of the container. Thus, the width of the divider portion is substantially equal to the height of the container.

Figure 5:
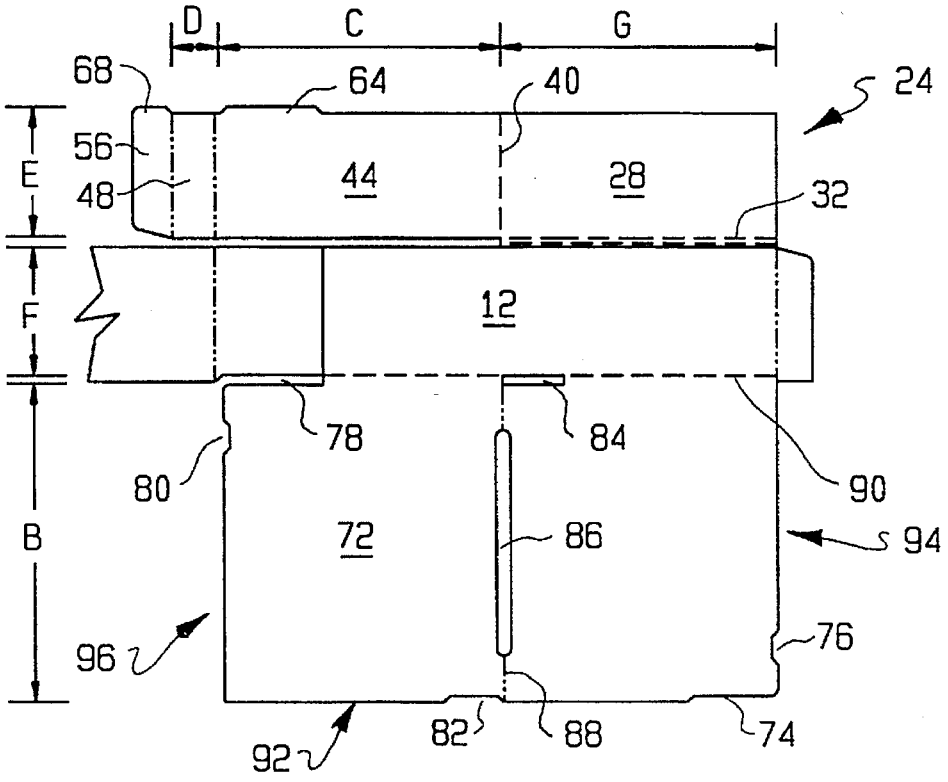
FIG. 5 is a detailed layout of a portion of a blank from which a container in accordance with the present invention is formed.

FIG. 2 shows the container to further have an inner bottom 72. It also has an outer bottom (not shown), for additional strength. As best shown in FIG. 5, the inner bottom 72 has a number of cutouts which are adapted to receive the aforementioned tabs. The tabs and cutouts ensure that the divider portions are maintained in a given position. They also provide a degree of torsional strength when the divider portions are in the second position.

Central cutout 86 extends in a direction parallel to the end walls 16, 18 in a central area of the inner bottom 72. Anchor tabs 64, 66 are inserted into central cutout 86 when the divider portions 36, 38 are in the second position depicted in FIG. 3.

Side wall edge center cutouts 82 and 84 are formed in the inner bottom 72 along a central portion of an inner bottom side wall edge 92, 90, respectively. More particularly, side wall edge center cutouts 82 and 84 are situated near the center point of the side walls, proximate to the ends of the central cutout 86, as shown in FIG. 5. End tabs 68, 70 are inserted into side wall edge center cutouts 82, 84, respectively, when the divider portions 36, 38 are in the second position, as shown in FIG. 3. The side wall edge center cutouts 82, 84 extend a short distance in opposite directions from an imaginary center line 88 coaxial with central cutout 86, as shown in FIG. 5. Alternatively, they may extend a short distance on either side of the imaginary center line.

The purpose of these cutouts and the tabs is to maintain the divider portions once they have been positioned. The cutouts and tabs help prevent the container's contents from unintentionally disturbing the deployed partitions. They also provide the container with more torsional strength.

Edge cutouts 78, 74 are formed in the inner bottom 72 along a portion of an inner bottom side wall edge 90, 92 proximate to an end wall. Thus, the edge cutouts 78, 74 are situated along the side walls proximate to the corners where each side wall 12, 14 intersects the end wall 16, 18, respectively. Edge cutouts 78, 74 are formed so as to receive anchor tabs 66, 64, respectively, when the divider portions 36, 38 are in the first position.

End wall edge cutouts 80, 76 are formed in the inner bottom 72 along a portion of an inner bottom end wall edge 96, 94 proximate to a side wall. The end wall edge cutouts 80, 76 are thus around the corner from edge cutouts 78, 74. End wall edge cutouts 80, 76 are formed so as to receive end tabs 68, 70, respectively, when the divider portions 36, 38 are in the first position.

In FIG. 3, A is approximately 12" and B is approximately 15". Thus, first sections 44, 46 are about 12" in length and the second sections 48, 50 are about 3" in length. End sections 56, 58 are 1" in length. Each section is separated from its neighbor by fold lines, as discussed earlier. These dimensions allow one to store two rows of letter size folders, each nearly 15" deep, two rows of legal size folders, each nearly 12" deep, or one row of each. Naturally, the orientation of the legal size folders will differ from that of the letter size folders.

Figure 4:
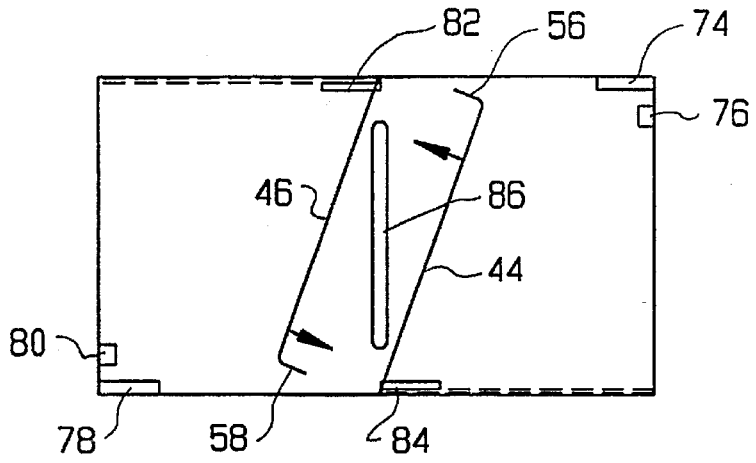
FIG. 4 is a top view of a container showing the divider portions being moved into the second position.

As best illustrated in FIG. 4, converting the container from having a single large compartment to two smaller compartments is straightforward. The anchor tabs 64, 66 and the end tabs 68, 70 are freed from the edge cutouts 78, 74 and from the end wall edge cutouts 80, 76, respectively. Then, the first sections are pivoted around the axis formed by the rows of perforations 40, 42 and swung around towards the downwardly folding attachment portion. The right-angled bend between the first and second section in each divider portion 36, 38 is then straightened out. Next, the fold lines 60, 62 are bent in the direction indicated by the arrows in FIG. 4. Finally, the end sections 56, 58 belonging to each of the two divider portions are tucked into the spaces formed between the respective opposite attachment portions 30, 28 and the opposite side walls 14, 12. In this process, the anchor tabs 64, 66 are inserted into central cutout 86 and end tabs 68, 70 are inserted into side wall edge center cutouts 82, 84, respectively.

FIG. 5 presents a partial layout of a blank in accordance with the present invention. Shown are a foldable member 24 attached to a side wall 12 which, in turn, is attached to an inner bottom 72. The length of the first section 44 is designated C and the length of the second section is designated by D. The height of the side wall 12 and the height of the first member 25 are designated by the dimensions E & F, respectively. In the preferred embodiment, E and F have approximately the same height. Furthermore, B, the width of the internal bottom 72, is substantially equal to the combined lengths of C and D. Thus, a partition of length C+D spans the entire width B of the container.

While the present invention is described with respect to a preferred embodiment, it should be understood that variations of the preferred embodiment are possible. For instance, the attachment and the divider portions may be proportioned such that the container is divided into two compartments of unequal size. Alternatively, only one foldable member may be provided rather than two. Also, the foldable members may be on the end wall rather than on the side walls. Other variations are passible, well. The true scope of the present invention is defined by the claims set forth below.

What is claimed is:

1. A container sized to hold one of letter size and legal size items, said container comprising:

a bottom having a bottom length and a bottom width, said bottom width substantially equal to said one of letter size and legal size items;

first and second spaced apart upright walls extending along the width of said bottom;

third and fourth spaced apart upright walls extending along the length of said bottom; and at least one folding member attached to an upper edge of one of said upright walls, said folding member comprising an attachment portion and a divider portion;

said attachment portion attached to said upper edge, and said divider portion attached to said attachment portion and arranged across said bottom, dividing the container into at least two compartments, a least one of which compartments is sized to hold the other of said one of letter size and legal size items.

2. A container according to claim 1 further comprising a second folding member attached to another of said upright walls.

3. A container sized to hold one of letter size and legal size items, said container comprising:

a bottom having a bottom length and a bottom width, said bottom width substantially equal to said one of letter size and legal size items;

a pair of spaced apart upright walls extending along the width of said bottom;

a pair of spaced apart upright walls extending along the length of said bottom;

a first folding member attached to an upper edge of a first upright wall, said first folding member comprising a first attachment portion and a first divider portion, said first attachment portion attached to said upper edge of said first upright wall; and a second folding member attached to an upper edge of a second upright wall, said second folding member comprising a second attachment portion and a second divider portion, said second attachment portion attached to said upper edge of said second upright wall, said first and second divider portions attached to respective first and second attachment portions, and arranged across said bottom, dividing the container into at least two compartments, a least one of which compartments is sized to hold the other of said letter size and legal size items.

4. A container comprising:

a bottom having a bottom length and a bottom width;

first and second end walls extending along the width of said bottom;

first and second side walls extending along the length of said bottom, each of said side walls having a first part and a second part and an upper edge; and at least one folding member attached to an upper edge of said first part of said first side wall, said folding member comprising:

an attachment portion having an attachment length, said attachment portion attaching said folding member to said upper edge of said first part of said first side walls, and a divider portion attached to the attachment portion, said divider portion comprising:

a first section attached to the attachment portion, said first section having a first length; and a second section attached to the first section, said second section having a second length such that a combined length of said first and second sections substantially equals said bottom width.

5. The container of claim 4 further comprising a second folding member attached to said second side wall.

6. The container of claim 4 further comprising fold lines between said first and second sections.

7. The container of claim 4 wherein a height of said divider portion is substantially equal to a height of said side walls.

8. The container of claim 4 wherein said first portion length is sufficient to extend from the attachment portion, along the second part of said first side wall, to an end wall.

9. The container of claim 8 further comprising:

a tab formed on an outer edge of said first section;

a first cutout formed in said bottom, said first cutout extending parallel to said end walls and being situated in a central portion of said bottom, said first cutout being adapted to receive said tab; and a second cutout formed in said bottom along a portion of a bottom side wall edge proximate to an end wall, said second cutout also being adapted to receive said tab.

10. The container of claim 4 further comprising a third section attached to the second section, said third section having a third length, wherein a combined length of the attachment portion and the first, second and third sections exceeds said bottom length.

11. The container of claim 10 further comprising fold lines between said first and second sections and between said second and third sections.

12. The container of claim 10 wherein said first portion length is sufficient to extend from the attachment portion, along the second part of said first side wall, to an end wall.

13. The container of claim 12 further comprising a tab formed on an outer edge of said third section;

a first cutout formed in said bottom along a central portion of a bottom side wall edge, said first cutout being adapted to receive said tab; and a second cutout formed in said bottom along a portion of a bottom end wall edge proximate to a side wall, said second cutout also being adapted to receive said tab.

14. The container of claim 12 further comprising:

a first tab formed on an outer edge of said first section;

a second tab formed on an outer edge of said third section;

a first cutout formed in said bottom, said first cutout extending parallel to said end walls and being situated in a central portion of said bottom, said first cutout being adapted to receive said first tab;

a second cutout formed in said bottom along a portion of a bottom side wall edge proximate to an end wall, said second cutout also being adapted to receive said first tab;

a third cutout formed in said bottom along a central portion of a bottom side wall edge, said third cutout being adapted to receive said second tab; and a fourth cutout formed in said bottom along a portion of a bottom end wall edge proximate to a side wall, said fourth cutout also being adapted to receive said second tab.

* * * * *